US007036608B2

(12) United States Patent
Garvey et al.

(10) Patent No.: US 7,036,608 B2
(45) Date of Patent: May 2, 2006

(54) APPARATUS FOR PRODUCING SELF-EXCITING HAMMER ACTION, AND ROTARY POWER TOOL INCORPORATING SUCH APPARATUS

(75) Inventors: Seamus D. Garvey, West Bridgford (GB); Jonathan Robin Crabtree, Abbots Leigh (GB)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/732,559

(22) Filed: Dec. 10, 2003

(65) Prior Publication Data

US 2004/0159452 A1 Aug. 19, 2004

(30) Foreign Application Priority Data

Dec. 10, 2002 (GB) ..... 02287737.3

(51) Int. Cl.
*B25D 11/10* (2006.01)

(52) U.S. Cl. ..... 173/122; 173/109; 173/111; 173/178; 173/205; 173/211; 192/150

(58) Field of Classification Search ..... 173/114, 173/109, 201, 110, 112, 117, 118, 202, 121, 173/124, 122, 205, 210, 211, 104, 178, 111; 192/56.2, 150

See application file for complete search history.

(56) References Cited

U.S. PATENT DOCUMENTS

| | | | | |
|---|---|---|---|---|
| 1,954,620 | A * | 4/1934 | Connell | 192/56.2 |
| 2,196,589 | A | 4/1940 | Jimerson | |
| 3,841,418 | A * | 10/1974 | Biersack | 173/109 |
| 3,881,554 | A | 5/1975 | Cooley et al. | |
| 4,073,348 | A * | 2/1978 | Schramm et al. | 173/48 |
| 4,304,047 | A | 12/1981 | Jesionowski | |
| 4,325,436 | A * | 4/1982 | Richter et al. | 173/13 |
| 4,719,976 | A * | 1/1988 | Bleicher et al. | 173/109 |
| 5,052,497 | A * | 10/1991 | Houben et al. | 173/109 |
| 5,277,259 | A * | 1/1994 | Schmid et al. | 173/13 |
| 5,350,025 | A * | 9/1994 | Campbell et al. | 173/111 |
| 5,673,758 | A * | 10/1997 | Sasaki et al. | 173/178 |
| 5,711,379 | A * | 1/1998 | Amano et al. | 173/48 |
| 5,941,360 | A * | 8/1999 | Putney et al. | 192/150 |
| 6,213,222 | B1 * | 4/2001 | Banach | 173/1 |

FOREIGN PATENT DOCUMENTS

| | | |
|---|---|---|
| GB | 747255 | 3/1956 |
| GB | 1 379 560 | 1/1975 |
| GB | 1 463 179 | 2/1977 |
| GB | 2 209 134 A | 5/1989 |
| GB | 2 234 464 A | 2/1991 |

* cited by examiner

*Primary Examiner*—Scott A. Smith
(74) *Attorney, Agent, or Firm*—Michael P. Leary; Charles F. Yocum; Adan Ayala

(57) ABSTRACT

An apparatus for providing percussion action in a rotary power tool having a rotary output shaft, the apparatus comprising at least one moveable mass adapted to have a component of movement parallel to the axis of the rotary output shaft to cause impacts to be applied to a working member of the tool; and a device for intermittently converting rotary movement of the rotary output shaft into movement of at least one the moveable mass to cause the impacts to be applied to the working member.

21 Claims, 6 Drawing Sheets

APPARATUS FOR PRODUCING SELF-EXCITING HAMMER ACTION, AND ROTARY POWER TOOL INCORPORATING SUCH APPARATUS

The present invention relates to an apparatus for providing percussive action in a rotary power tool, and to a rotary power tool incorporating such apparatus. The invention relates particularly, but not exclusively, to hammer action drills.

BACKGROUND OF THE INVENTION

Repeated hammering action is provided in drills for masonry and other hard materials. In one known type of hammer drill, a drill bit is carried in a chuck fixed to a working shaft which is driven via a gear from another shaft, the working shaft carrying the chuck being free to move axially over a small range of distances. A ratchet ring is fixed to the end of the working shaft opposite to the chuck end, and a corresponding ratchet ring is fixed to the body of the tool. One extreme of the allowable axial movement of the working shaft is set by the contact of the two ratchet rings, and this extreme is a function of the angle of rotation of the working shaft. When a user operates the tool, the working shaft is forced backwards such that the two ratchet plates come into contact with each other, and relative rotation of the ratchet rings causes a series of impulses to occur.

Ratchet ring arrangements of this type are relatively inexpensive to construct, but suffer from the drawback that the impulses acting on the working shaft and ultimately passing into the drill bit also have a reaction on the body of the tool, which results in substantial shaking of the tool. A further disadvantage is that friction losses between the two ratchet plates are relatively high.

A further known type of hammer drill which benefits from substantially lower tool body vibration, lower loss of torque at the instant of impact, and more effective impact in most cases because the impulses are generated closer to the drill bit, incorporates a flying striker mass. However, hammer drills of this type require direct axial excitation of the flying striker mass, as a result of which they are expensive to construct.

BRIEF DESCRIPTION OF THE INVENTION

Preferred embodiments of the present invention seek to overcome the above disadvantages of the prior art.

According to an aspect of the present invention, there is provided an apparatus for providing percussion action in a rotary power tool having a rotary output shaft, the apparatus comprising at least one moveable mass adapted to have a component of movement parallel to the axis of the rotary output shaft to cause impacts to be applied to a working member of the tool; and conversion means for intermittently converting rotary movement of the rotary output shaft into movement of at least one the moveable mass to cause the impacts to be applied to the working member.

By providing an apparatus in which rotary movement of a rotary output shaft is intermittently converted into linear movement of a moveable mass which then causes impacts to be applied to an working member such as a drill bit, this provides the advantage that the apparatus is less expensive to manufacture than an apparatus requiring direct axial excitation of a flying striker mass, while reducing wear of moving parts compared with the prior art apparatus using ratchet plates. The invention also has the advantage that because the conversion means intermittently converts rotary movement of the output shaft into movement of at least one moveable mass, under certain circumstances it is possible to arrange the frequency of the percussive impulse applied to the working member of the tool to be substantially independent of the rotational frequency of the output shaft. This is highly advantageous in the field of power tools, since a power tool such as a drill will have an optimum rotational frequency range within which its percussive action operates most efficiently, but the rotational frequency of the drill will reduce when the drill bit encounters resistance. As the rotational frequency of the drill changes, it is difficult to maintain the percussion action within its optimum frequency range if the percussion frequency is dependent upon the rotational frequency of the output shaft. By making the percussion and rotational frequencies substantially independent of each other, this problem can be overcome.

The conversion means is preferably adapted to convert said rotary movement of the rotary output shaft into movement of at least one said moveable mass in a direction substantially parallel to the axis of rotation of the rotary output shaft. The conversion means may be adapted to intermittently convert rotary motion of said rotary output shaft into movement of at least one said moveable mass such that times when said conversion means converts said rotary movement of the rotary output shaft into movement of at least one said moveable mass alternate with times when impacts are applied to the working member. This provides the advantage of reducing the extent to which the percussion action transfers impulses to the motor of the tool, which could otherwise cause damage to the tool.

The apparatus may further comprise at least one impact member adapted to be impacted by at least one said moveable mass to cause impacts to be applied to the working member, wherein at least one of the mutually impacting surfaces of at least one said impact member and the corresponding movable mass are so shaped that energy associated with said mutual impacts is not dissipated substantially by air damping. This provides the advantage of minimising energy loss through rapid expulsion of air as said moveable mass applies a percussive impulse to the working member of the tool. At least one of said mutually impacting surfaces may be non-planar.

The conversion means may include at least one helical spring. The conversion means may further comprise restraining means for resisting expansion of the or each said helical spring in a radial direction. The restraining means may comprise at least one hoop, pin or strut mounted within at least one said spring.

The apparatus may further comprise clutch means having a first clutch member adapted to rotate with said rotary output shaft, and a second clutch member connected to said conversion means and adapted to intermittently engage said first clutch member and be rotated thereby to cause movement of at least one said moveable mass. The second clutch member may be adapted to disengage from said first clutch member when the or each said moveable mass applies an impact to said working member.

The second clutch member may include a substantially frustoconical outer surface adapted to frictionally engage a corresponding surface of said first clutch member. The cone angle of said substantially frustoconical outer surface is preferably not less than the friction angle between said substantially frustoconical surface and the corresponding surface of said first clutch member. This provides the advantage of minimising the risk of the second clutch member becoming wedged on the first clutch member.

The apparatus may further comprise rotation resisting means for causing relative rotation between said rotary output shaft and at least one said moveable mass. This provides the advantage of maximising the extent of actuation of said conversion means. The rotation resisting means may comprise means for resisting rotation of at least one said moveable mass relative to the housing of the tool. The rotation resisting means may be magnetic.

The apparatus may further comprise biasing means for biasing at least one said moveable mass in such a direction as to actuate said conversion means. The biasing means may include at least one spring. The biasing means may be magnetic.

According to another aspect of the present invention, there is provided a rotary power tool comprising a housing, drive means for causing rotation of a rotary output shaft, a rotary output shaft connected to said drive means, and an apparatus as defined above. The tool may further comprise de-actuating means for de-actuating said apparatus.

Limited axial movement of said rotary output shaft relative to the location at which at least one said moveable mass applies a percussive impulse to said working member may be possible. This provides the advantage of minimising transfer of said impulse to the drive means, which could otherwise cause damage to a drive means such as a motor.

The tool may further comprise at least one further shaft adapted to be rotated by means of, and move axially relative to, said rotary output shaft. At least one said further shaft may be splined and substantially co-axial with said rotary output shaft. At least one said further shaft may be radially separated from said rotary output shaft.

BRIEF DESCRIPTION OF THE DRAWINGS

Preferred embodiments of the invention will now be described, by way of example only and not in any limitative sense, with reference to the accompanying drawings, in which.

DETAILED DESCRIPTION OF THE INVENTION

Figure 1:
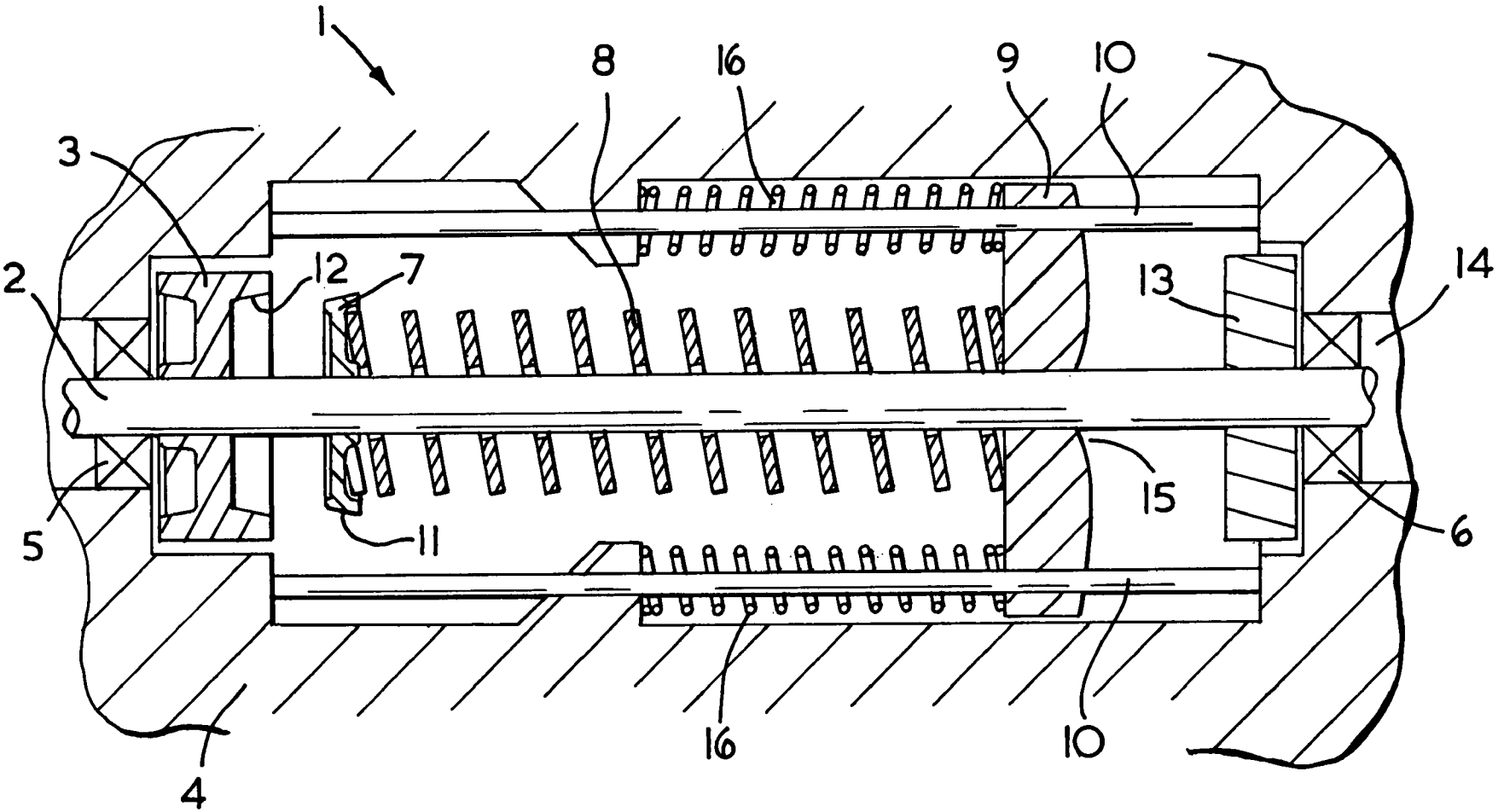
FIG. 1 is a side cross-sectional view of part of a first embodiment of the hammer drill of the present invention.

Referring to FIG. 1, a hammer drill 1 includes a percussive hammer apparatus mounted to a working shaft 2 of the drill. The working shaft 2 is rotated at a generally steady rotational speed by means of a motor (not shown) via a gear reduction mechanism including an integral gear 3 on working shaft 2. The working shaft 2 is mounted to a housing 4 of the drill by means of bearings 5, 6.

The apparatus 1 includes a first mass 7 connected via a helical spring 8 to a second mass 9, the second mass 9 being larger than the first mass 7. The first mass 7 and second mass 9 are free to slide and rotate relative to the working shaft 2, but the second mass 9 is prevented from rotating relative to the housing 4 by means of a pair of parallel bars 10.

The first mass 7 has a generally frustoconical outer surface 11 which mates with a corresponding frustoconical surface 12 on integral gear 3 such that when the frustoconical surfaces 11, 12 are fully in contact with each other, the cone angle, which is around 15°, causes a relatively large frictional torque for a relatively small amount of axial force pushing the first mass 7 into contact with the integral gear 3. The cone angle is not less than the friction angle $\tan^{-1}\mu$, where $\mu$ is the coefficient of friction between first mass 7 and integral gear 3, as a result of which the first mass 7 does not become stuck in engagement with frustoconical surface 12 when the spring 8 exerts any traction force tending to pull the first mass 7 away from the integral gear 3.

At the limiting value of this condition (i.e. when the cone angle is exactly equal to $\tan^{-1}\mu$) the net frictional torque between the integral gear 3 and the first mass 7 has a maximum value of $RF_S$, where R is the mean radius of frustoconical surface 11 and $F_S$ is the compression force in the spring 8.

$$T_S = RF_S$$

The characteristics of the helical spring 8 are such that it causes a coupling between twist and axial compression/extension deformation. For some limited range of deformation, the torque and compression force in the spring are generally linearly related to the axial compression deformation and twist deformation of the spring through three spring constants $k_{FF}$, $k_{FT}$, $k_{TT}$ as follows:

$$\left[\frac{F_S}{T_S}\right] = \left[\frac{k_{FF}k_{FT}}{k_{FT}k_{TT}}\right]\left[\frac{\delta}{\alpha}\right]$$

In which $F_S$ and $T_S$ are the compression force and torque in the spring, and $\delta$ and $\alpha$ are the compression deformation and twist deformation of the spring respectively. Spring constants $k_{FF}$, $k_{TT}$, and $k_{FT}$ are the spring constants corresponding to compression, twist, and combined compression and twist respectively. The torque is defined such that positive $T_S$ corresponds to a torque tending to accelerate the second mass 9 in the same direction as the rotation of the working shaft 2.

The general increment in stored energy $\Delta SE$ in the spring for a change in deformation $\Delta\delta$, $\Delta\alpha$ is as follows:

$$\Delta SE = F_S.\Delta\delta + T_S.\Delta\alpha = k_{FF}\delta.\Delta\delta + k_{FT}\alpha.\Delta\delta + k_{FT}\delta.\Delta\alpha + k_{TT}\alpha.\Delta\alpha$$

the total stored energy SE therefore being $$SE = \tfrac{1}{2}k_{FF}\delta^2 + k_{FT}\delta\alpha + \tfrac{1}{2}k_{TT}\alpha^2$$

this is positive for all values of $\delta$ and $\alpha$ if $$(k_{FF}k_{TT}) - (k_{FT})^2 \geqq 0$$

Provided that $k_{FT}$ is positive (i.e. the handedness of the helical spring is such that turning the end nearest the integral gear 3 in the direction of rotation of the working shaft 2 tends to elongate the spring 8) then the presence of any torque at the interface between the first mass 7 and integral gear 3 will tend to increase the axial force reacted at the contact between frustoconical surfaces 11, 12 and therefore increase the maximum possible interface torque.

The characteristics of the spring of the apparatus of the present invention are therefore chosen such that the existence of any positive torque at the interface between frustoconical surfaces 11, 12 rapidly leads to the elimination of any rotational slip. It follows that the spring characteristic should be such that any increase in $T_S$, $\Delta T_S$, which takes place without extension of the spring should result in an increase in $F_S$, $\Delta F_S$, greater than $\Delta T_S/R$. This condition is satisfied if $k_{FF}R$ is greater than $k_{FT}$.

The rotation of the first mass 7 causes axial movement of the second mass 9, which delivers percussive impulses to an impulse face 13 mounted on the working shaft 2 near to a chuck 14 to which a drill bit (not shown) is mounted. The second mass 9 has a recess 15 adjacent the working shaft 2 to minimise energy loss caused by rapid expulsion of air from between two parallel surfaces. The second mass 9 is biased by means of a pair of springs 16 towards the integral gear 3.

The operation of the hammer drill 1 shown in FIG. 1 will now be described.

If the working shaft 2 is rotating at a steady rotational speed and the first mass 7, second mass 9 and spring 8 are initially stationary and the first mass 7 is not in contact with the integral gear 3, the small pre-load force of springs 16 urges the first mass 7 into contact with the integral gear 3. At the moment of contact, a torque at the interface between frustoconical surfaces 11, 12 rotates first mass 7 and increases the compressive force in helical spring 8.

The increase in compressive force increases the frictional torque between integral gear 3 and first mass 7, which rapidly causes the interface to lock so that the first mass 7 has the same angular velocity as the working shaft 2. Because the second mass 9 is prevented by parallel bars 10 from rotating with the first mass 3, the helical spring 8 then begins to acquire twist, as a result of which the axial compression force in the helical spring 8 increases significantly.

As a result, the second mass 9 is urged towards impulse face 13 while the spring has a compressive force. The compressive force of spring 8 then decreases, causing the first mass 7 to separate from integral gear 3, and the second mass 9 then strikes impulse face 13. The second mass 9 is then urged by springs 16 back towards integral gear 3 to bring first mass 7 into contact with the integral gear, and the process then repeats itself. After a small number of cycles, the system develops a steady state behaviour in which there is a regular impulse, and the frequency of this impulse is set largely by the mass of the second mass 9 and the characteristics of helical spring 8. It is therefore found that this frequency is generally insensitive to the rotational speed of the working shaft 2.

Figure 2:
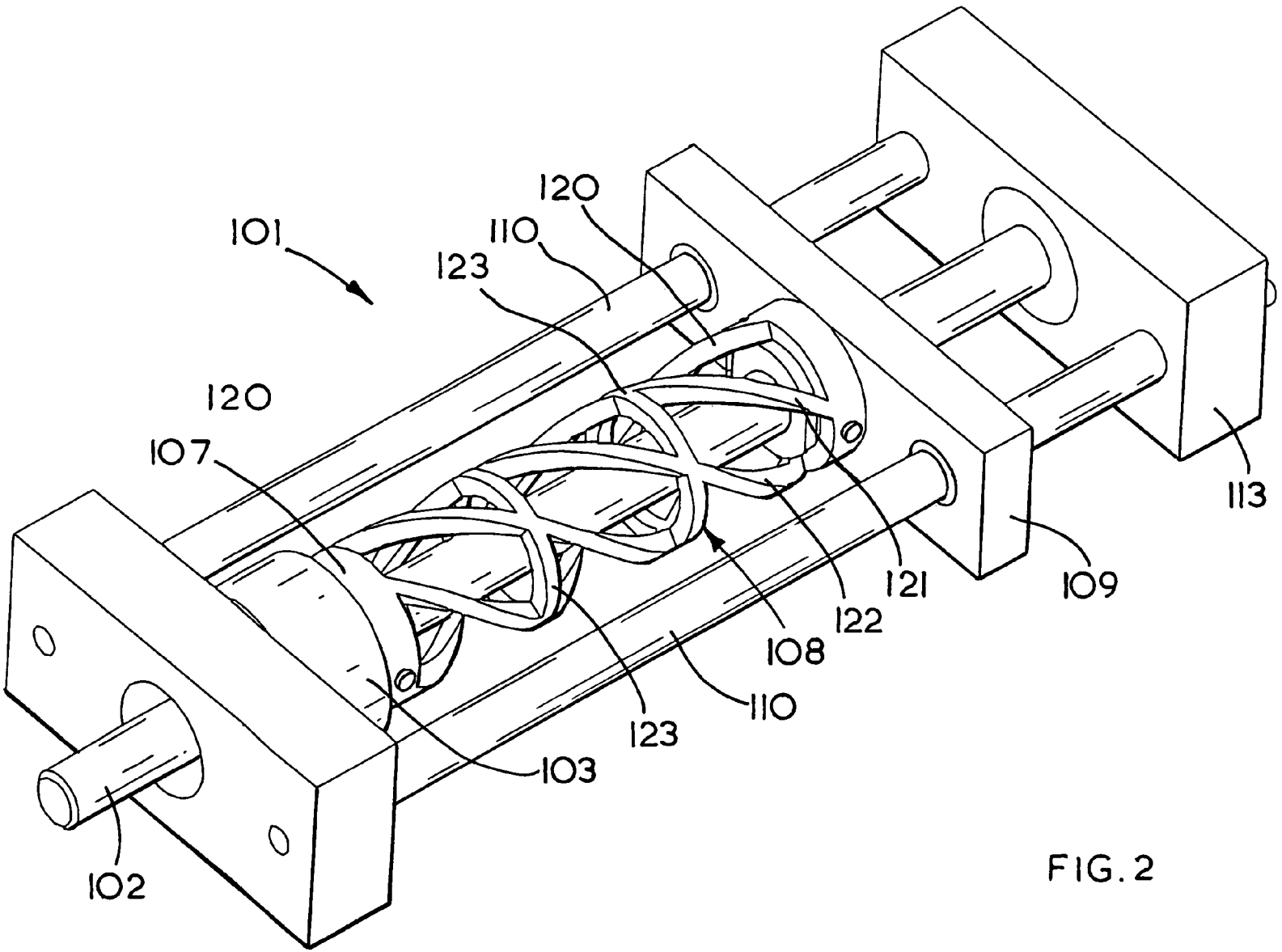
FIG. 2 is a perspective view of part of a second embodiment of a hammer drill according to the present invention.
Figure 3:
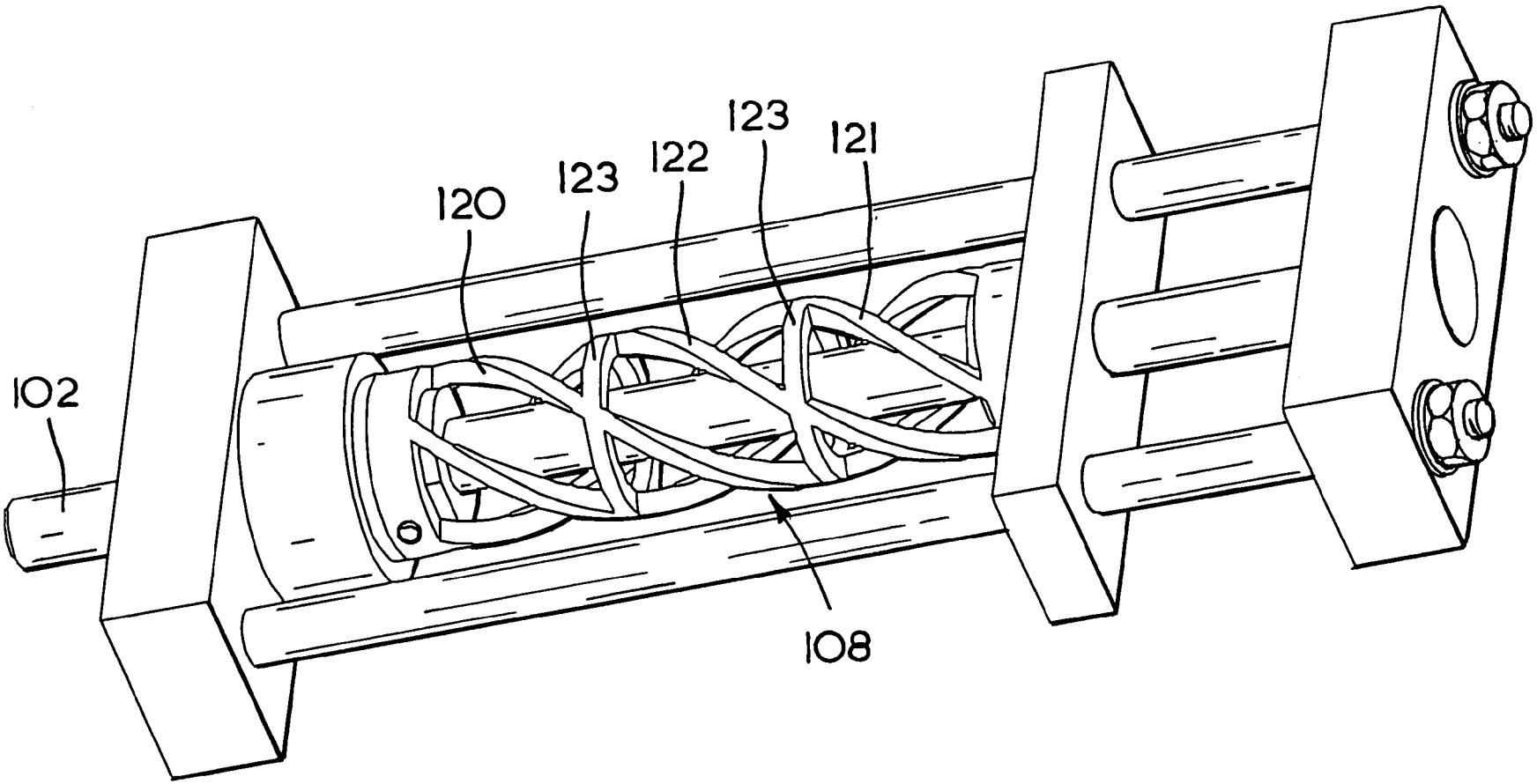
FIG. 3 is a further perspective view of the apparatus of FIG. 2.
Figure 4:
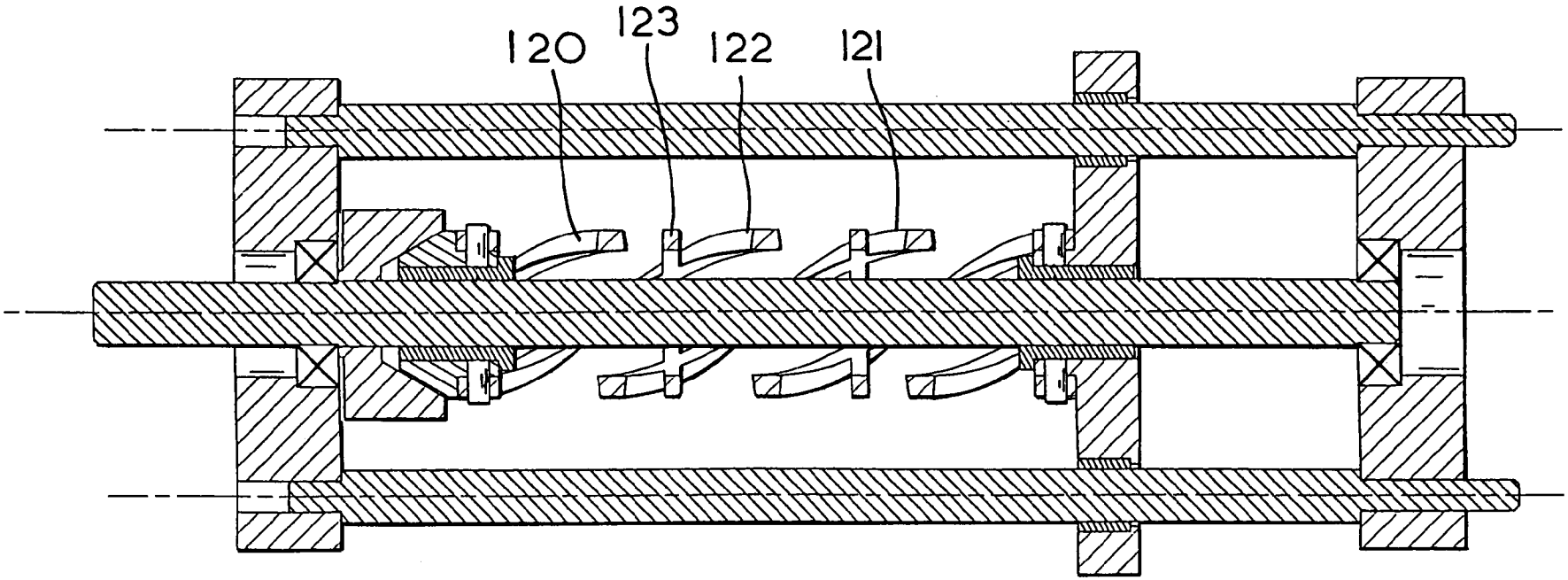
FIG. 4 is a side cross-sectional view of the apparatus of FIGS. 2 and 3.

Referring now to FIGS. 2 to 4, in which parts common to the embodiment of FIG. 1 are denoted by like reference numerals but increased by 100, a hammer drill 101 of a second embodiment of the invention has a first mass 107 connected to a second mass 109 by means of a helical spring 108 including three individual helices 120, 121, 122 which are connected together by means of a series of rings 123. The spring 108 of the embodiment of FIGS. 2 to 4 has the advantage of minimising radial expansion of the spring 108 as it acquires twist, which may otherwise reduce the extent to which the spring 108 converts rotary movement of first mass 107 into axial movement of second mass 109.

Figure 5:
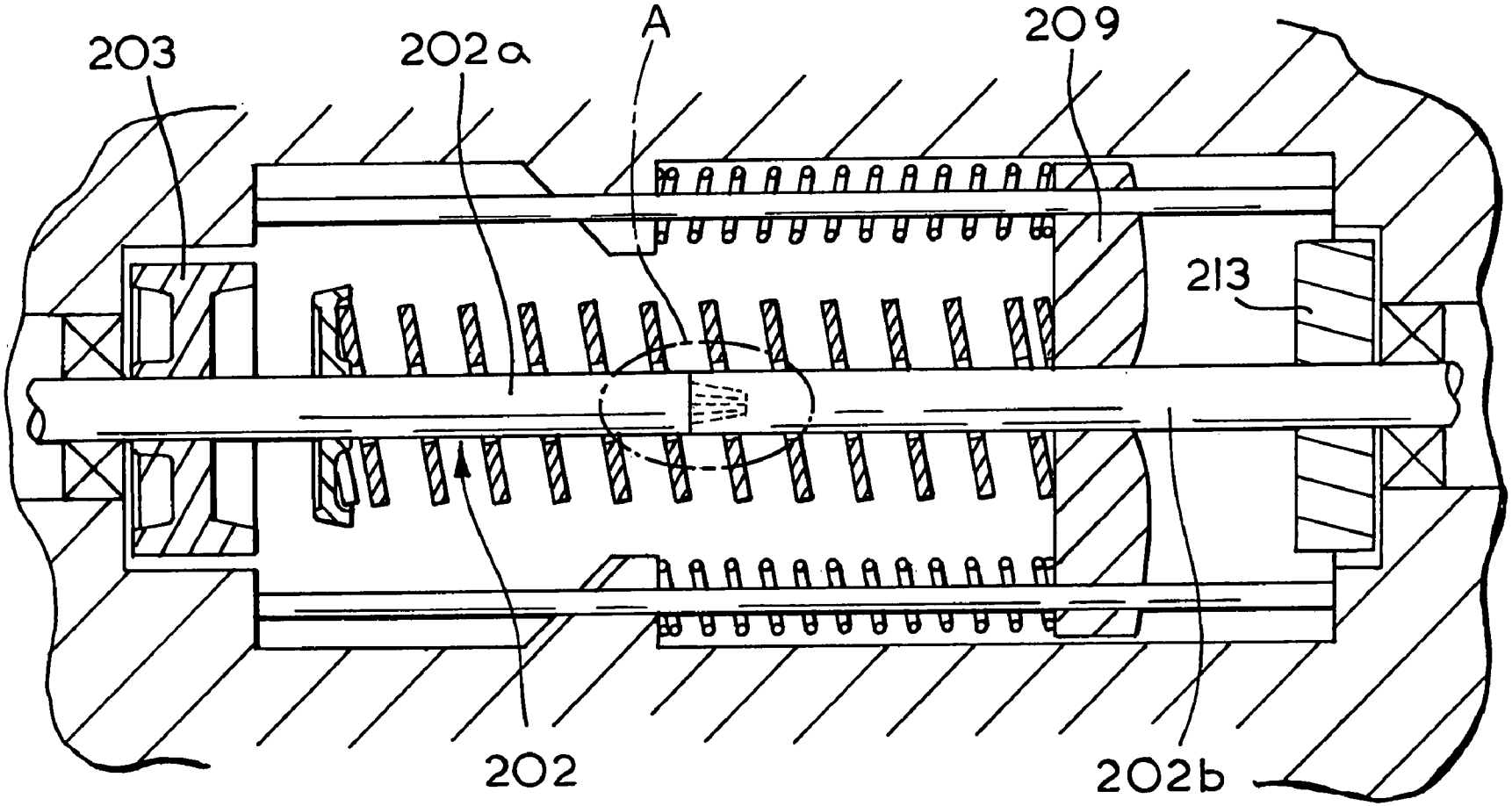
FIG. 5 is a schematic side cross-sectional view of part of a third embodiment of a hammer drill of the present invention.
Figure 6:
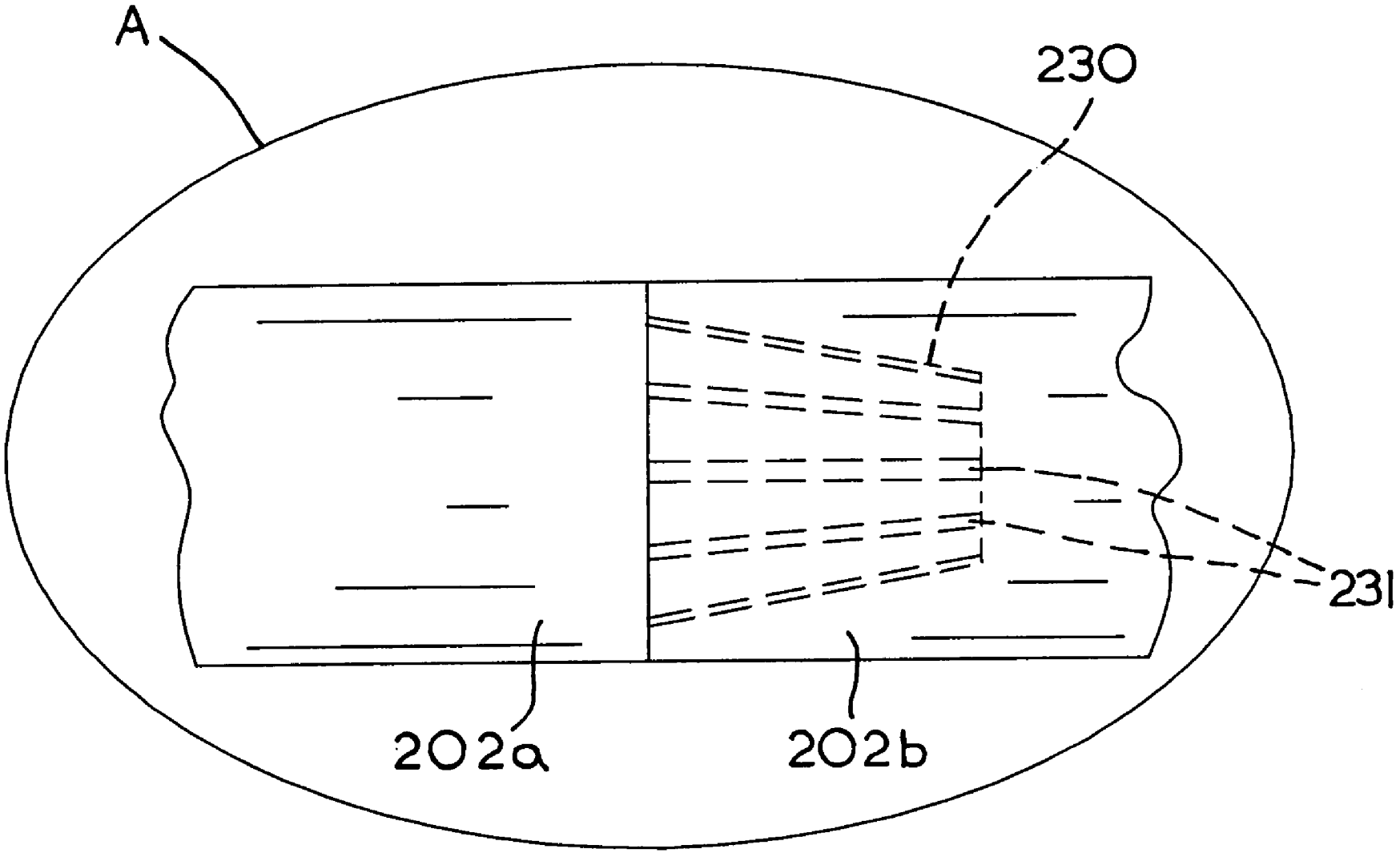
FIG. 6 is an enlarged view of region A of the drill of FIG. 5.

Referring to FIGS. 5 and 6, in which parts common to the embodiment of FIG. 1 are denoted by like reference numerals but increased by 200, a hammer drill 201 of a third embodiment of the invention has a working shaft 202 comprising a rear part 202*a* fixed relative to integral gear 203 and motor (not shown), and a front part 202*b* which is axially slidable to a limited extent relative to the rear part 202*a*. As shown in greater detail in FIG. 6, which is an enlarged schematic view of region A in FIG. 5, the rear part 202*a* and front part 202*b* are connected to each other by means of a generally frustoconical projection 230 on rear part 202*a* (shown in dotted lines in FIG. 6), which is received in a correspondingly shaped recess in the front part 202*b*. The front and rear parts 202*a*, 202*b* are splined, i.e. provided with ridges and grooves 231 so that when the front part 202*b* is in mating contact with the rear part 202*a*, rotation of the rear part causes corresponding rotation of the front part.

In the third embodiment of FIGS. 5 and 6, when the second mass 209 strikes impulse face 213, part of the impulse delivered to the housing (acting towards the right in FIG. 5) is transferred to the front part 202*b* of working shaft 202. This causes front part 202*b* to move to a limited extent to the right in FIGS. 5 and 6, which minimises the extent to which the impulse is transmitted via rear part 202*a* to the motor. This in turn minimises the extent to which the impulse transmitted to the tool housing is transferred via working shaft 202 to the motor, which could otherwise damage the motor.

It will be appreciated by persons skilled in the art that the above embodiments have been described by way of example only, and not in any limitative sense, and that various alterations and modifications are possible without departure from the scope of the invention as defined by the appended claims. For example, instead of providing a working shaft 202 which consists of two parts 202*a*, 202*b* which can move axially relative to each other, it is possible to minimise the extent to which the impulse delivered to the tool housing is transferred back to the working shaft 202 by rotating the drill bit by means of a further shaft parallel to the working shaft 202, so that the working shaft does not need to be in direct engagement with the motor. Also, it is possible to provide means to selectively disengage the hammer action of the present invention, for example by providing means for permanently disengaging the first mass 7 from the integral gear 3 and/or clamping the second mass 9 to the impulse face 13 when not in hammer mode (i.e. when in conventional drilling mode).

The invention claimed is:

1. An apparatus for providing percussion action in a rotary power tool including a working member and a rotary output shaft defining an axis, the percussion apparatus comprising:

a moveable mass movable parallel to the axis of the rotary output shaft to cause impacts to be applied to the working member of the tool;

conversion means for intermittently converting rotary movement of the rotary output shaft into movement of the moveable mass;

a clutch means including a first clutch member adapted to rotate with the rotary output shaft, and a second clutch member connected to the conversion means and adapted to intermittently engage the first clutch member and be rotated thereby to cause movement of the moveable mass and wherein the second clutch member is adapted to disengage from the first clutch member when the moveable mass applies an impact to the working member.

2. An apparatus according to claim 1, wherein the conversion means is adapted to convert the rotary movement of the rotary output shaft into movement of the moveable mass in a direction substantially parallel to the axis of rotation of the rotary output shaft.

3. An apparatus according to claim 1, wherein the conversion means is adapted to intermittently convert rotary motion of the rotary output shaft into movement of the moveable mass such that a first interval when the conversion means converts the rotary movement of the rotary output shaft into movement of the moveable mass alternates with a second interval when impacts are applied to the working member.

4. An apparatus according to claim 1 and further comprising an impact member adapted to be impacted by the moveable mass to cause impacts to be applied to the working member, the impact member including a first impact surface, and the moveable mass including a second impact surface for impacting the first impact surface, and wherein one of the first impact surface and the second impact surface include a recess so shaped that energy associated with the mutual impacts is not dissipated substantially by air damping.

5. An apparatus according to claim 4, wherein one of the first impact surface and the second impact surface is non-planar.

6. An apparatus according to claim 1, wherein the conversion means includes a helical spring.

7. An apparatus according to claim 6, wherein the conversion means further includes a restraining means for resisting radial expansion of the helical spring when the helical spring acquires twist.

8. An apparatus according to claim 7, wherein the restraining means includes a ring adapted to restrain the radial expansion of the spring.

9. An apparatus according to claim 1 and wherein the first clutch member includes a first substantially frustoconical surface and the second clutch member includes a second substantially frustoconical surface adapted to frictionally engage the first substantially frustoconical surface of the first clutch member.

10. An apparatus according to claim 9, wherein a cone angle of the first substantially frustoconical surface is not less than the friction angle between the first substantially frustoconical surface and the second substantially frustoconical surface.

11. An apparatus according to claim 1 and further comprising a rotation resisting means for causing relative rotation between the rotary output shaft and the moveable mass.

12. An apparatus according to claim 11 and wherein the rotation resisting means includes a means for resisting rotation of the moveable mass relative to the housing of the tool.

13. An apparatus according to claim 1 and further comprising a biasing means for biasing the moveable mass into a first position so as to actuate the conversion means.

14. An apparatus according to claim 13, wherein the biasing means includes a spring.

15. A rotary power tool comprising:

a housing;

a rotary output shaft defining an axis;

drive means drivingly connected to the rotary output shaft;

a working member adapted to receive impacts; and a percussion apparatus, the apparatus including a moveable mass movable parallel to the axis of the rotary output shaft to cause impacts to be applied to the working member of the tool and conversion means for intermittently converting rotary movement of the rotary output shaft into movement of the moveable mass, said conversion means including a helical spring connected to the movable mass and intermittently connected to the rotary output shaft, whereby a twist imparted to the helical spring by the rotary shaft is converted into axial oscillations of the movable mass.

16. A tool according to claim 15, further comprising de-actuating means for de-actuating the percussion apparatus.

17. A tool according to claim 15, wherein the rotary output shaft is limited axial movable a limited distance relative to the location at which the moveable mass strikes the working member.

18. A tool according to claim 15, further comprising an output spindle rotatably connected to and axially movable relative the rotary output shaft.

19. A tool according to claim 18 and further comprising a spline connection and wherein the output spindle is substantially co-axial with the rotary output shaft and drivingly connected to the rotary output shaft by the spline connection.

20. A tool according to claim 18 and wherein the output spindle is parallel to and radially separated from the rotary output shaft.

21. A rotary power tool comprising:

a housing;

a rotary output shaft defining an axis;

rotary drive means drivingly connected to the rotary output shaft;

a tool holder drivingly connected to the rotary output shaft; and a percussion apparatus, the percussion apparatus including:

a first moveable mass movable rotationally and axially relative to the axis of the rotary output shaft;

a second movable mass axially movable relative to the axis of the rotary output shaft;

a spring connected between the first movable mass and the second movable mass;

a first clutch portion rotatably connected to the rotating drive means;

a second clutch portion connected to the first movable mass and connectable to the first clutch portion for rotationally driving the first movable mass; and whereby intermittent contact between the first and second clutch portions imparts a twisting movement to the first movable mass and the spring, the spring translates the twisting movement into an oscillating axial movement of the second movable mass, and the oscillating axial movement of the second movable mass delivers intermittent impacts to the tool holder.

* * * * *